US005223319A

United States Patent [19]

Cotton et al.

[11] Patent Number: 5,223,319

[45] Date of Patent: Jun. 29, 1993

[54] NONWOVEN WIPER HAVING HIGH OIL CAPACITY

[75] Inventors: James D. Cotton, Marietta, Ga.; Paul J. King, Kaukauna, Wis.

[73] Assignee: Kimberly-Clark Corporation, Neenah, Wis.

[21] Appl. No.: 565,543

[22] Filed: Aug. 10, 1990

[51] Int. Cl.[5] ..... B32B 3/10

[52] U.S. Cl. ..... 428/131; 156/252; 264/119; 264/154; 264/280; 428/171; 428/903; 428/913; 428/224; 428/219

[58] Field of Search ..... 428/131, 171, 903, 224, 428/219; 264/119, 154, 280; 156/252; 15/209 R

[56] References Cited

U.S. PATENT DOCUMENTS

| | | | |
|---|---|---|---|
| 3,616,157 | 10/1971 | Smith | 428/171 |
| 4,307,143 | 12/1981 | Meitner | 428/171 |
| 4,588,630 | 5/1986 | Shimalla | 428/171 |
| 4,612,226 | 9/1986 | Kennette et al. | 428/131 |
| 4,614,679 | 9/1986 | Farrington et al. | 428/131 |
| 4,629,643 | 12/1986 | Curro et al. | 428/171 |
| 4,737,394 | 4/1988 | Zafiroglu | 428/257 |
| 4,774,124 | 9/1988 | Shimalla et al. | 428/171 |
| 4,886,632 | 12/1989 | Van Iten | 264/154 |
| 4,950,526 | 8/1990 | Singleton | 428/171 |

*Primary Examiner*—James J. Bell
*Attorney, Agent, or Firm*—William D. Herrick

[57] ABSTRACT

The present disclosure is directed to a nonwoven wiper having an oil capacity greater than about 500 percent by weight of oil to the weight of the web. The wiper includes a nonwoven web of fibers having at least one raised surface area which area has an aperture through the web. The fibers generally adjacent the aperture are substantially unconsolidated, i.e., not compacted together or fused.

The disclosure also deals with a method of forming such a nonwoven wiper. The method includes the steps of: a) providing a nonwoven web; b) providing a nip roller arrangement including a first roller having a plurality of unheated pins and a second roller having a plurality of corresponding orifices; and c) passing the web through the nip roller arrangement to form a plurality of raised surface areas on the web with each of the surface areas defining an aperture where the fibers generally adjacent the aperture are substantially unconsolidated.

19 Claims, 6 Drawing Sheets

NONWOVEN WIPER HAVING HIGH OIL CAPACITY

BACKGROUND OF THE INVENTION

The present invention relates to nonwoven wipers for industrial and other applications involving the absorption of water and/or oil.

Generally, industrial wipers must be able to quickly pick up spilled liquids, both oil based or water based, and leave a clean streak-free surface. Also, they must have sufficient capacity to hold such liquids within the wiper structure until it is desired to remove the liquids by wringing or washing. Further, they must have the strength to withstand shredding, tearing, etc. during use, and also to withstand rinsing and manual wringing. It is also desirable that they have a feel that is pleasing to the touch.

At least three types of wipers are available: paper, woven cloth or nonwoven. Paper wipers, while inexpensive, are suitable primarily for use in wiping aqueous materials and are not entirely satisfactory for use with oil. Cloth wipers, while suitable for wiping both oils and water, are expensive and must be laundered. Unless care is taken in laundering, water absorption rates for cloth wipers can be adversely affected.

Nonwoven wipers have the advantage over woven cloth wipers of being cost effective and disposable. Nonwoven wipers are made by forming filaments or fibers and depositing them on a carrier in such manner so as to cause the filaments or fibers to overlap or entangle as a web of a desired basis weight. The web is bonded by entanglement, adhesive, application of heat and/or pressure to thermally responsive fibers, or, most commonly, by a point application of heat and pressure, using patterned bonding rollers. Commonly used nonwoven manufacturing processes include carding, wetlaying and needling, spunbonding and meltblowing.

In the past, nonwoven industrial wipers have not provided the same desired performance as woven shop towels, particularly, in terms of the holding capacity for both oil and water. This problem is believed to be partially due to the bonds. At bond points produced by heat and pressure, the thermoplastic microfibers fuse together, resulting in strengthening of the web structure. However, the fusion of the fibers results in the creation of solid spots of non-absorbent thermoplastic. Not only are these spots not absorbent, but they can also act as barriers to the flow or transfer of fluid within the web. This can be particularly harmful if a line type of bonding pattern is adopted, since the lines of fused thermoplastic act as dams beyond which fluid cannot flow.

Accordingly, there is a need for an industrial nonwoven wiper which has improved oil and water capacity.

SUMMARY OF THE INVENTION

In order to improve the performance of wipers there is provided a nonwoven wipe having high oil absorbing capacity. In particular, there is provided a nonwoven wiper having an oil capacity greater than about 500 percent by weight of oil to the weight of the web. The wiper includes a nonwoven web of fibers having at least one raised surface area. The raised surface area has an aperture therein and the fibers generally adjacent the aperture are substantially unconsolidated.

As used herein, "substantially unconsolidated" means that the fibers generally adjacent the aperture have some freedom of movement and are not fixed in position with respect to the other fibers of the web. In other words, the fibers generally adjacent the aperture are not compacted together or fused to the extent that the aperture cannot close, rather, the aperture may be blocked by some fiber strands which extend across, and partially obstruct it.

In one embodiment the nonwoven web is a spunbonded web made of polypropylene fibers.

The basis weight of the wiper may range from about 0.5 to about 5.00 ounces per square yard. For example, the basis weight of the wiper may range from about 1.50 to about 2.50 ounces per square yard. In one particular embodiment where the nonwoven web is a spunbonded web, the basis weight of the web is about 1.89 ounces per square yard.

In some embodiments the nonwoven web may have a plurality of raised surface areas with both surfaces of the web having raised areas. In particular, the raised surface area may have an average height, measured from the base plane of the web in the z-direction of the web to the most extended fibers of the raised area from about 0.0075 to about 0.125 inches. Generally, the number of raised areas averages from about 6 per square inch of available wiper surface area to about 400 per square inch. For example, the number of raised areas may average about 100 per square inch of available wiper surface area.

The invention is also directed to a method of forming a nonwoven wiper having an oil capacity of greater than about 500% by weight of the wiper. The method includes the steps of a) providing a nonwoven web; b) providing a nip roller arrangement including a first roller having a plurality of unheated pins and a second roller having a plurality of unheated corresponding orifices; and c) passing the web through the nip roller arrangement to form a plurality of raised surface areas on the web with each of the surface areas defining an aperture where the fibers generally adjacent the aperture are substantially unconsolidated.

As used herein, the term "unheated" means that the temperature is substantially less than the point of melting of a nonwoven substrate, such that an unheated surface brought into contact with the substrate will not fuse fibers of the substrate together.

The pins may have a shaft diameter of from about 0.030 to about 0.250 of an inch. For example, the shaft diameter of the pins may be about 0.072 of an inch. Each pin may have a chamfered end with a chamfer angle which ranges from about 45 degrees to about 90 degrees. Additionally, the depth of penetration of the pins through the web may range from about 0.015 to about 0.220 of an inch. Also, the pins may be formed from a metal, such as stainless steel.

To allow inter engagement of the pins and orifices, the orifice diameter is at least about 0.010 inch greater than the diameter of the corresponding pin shaft.

The invention is also directed to the products formed by the present inventive process.

DETAILED DESCRIPTION OF THE PREFERRED EMBODIMENT

Figure 1:
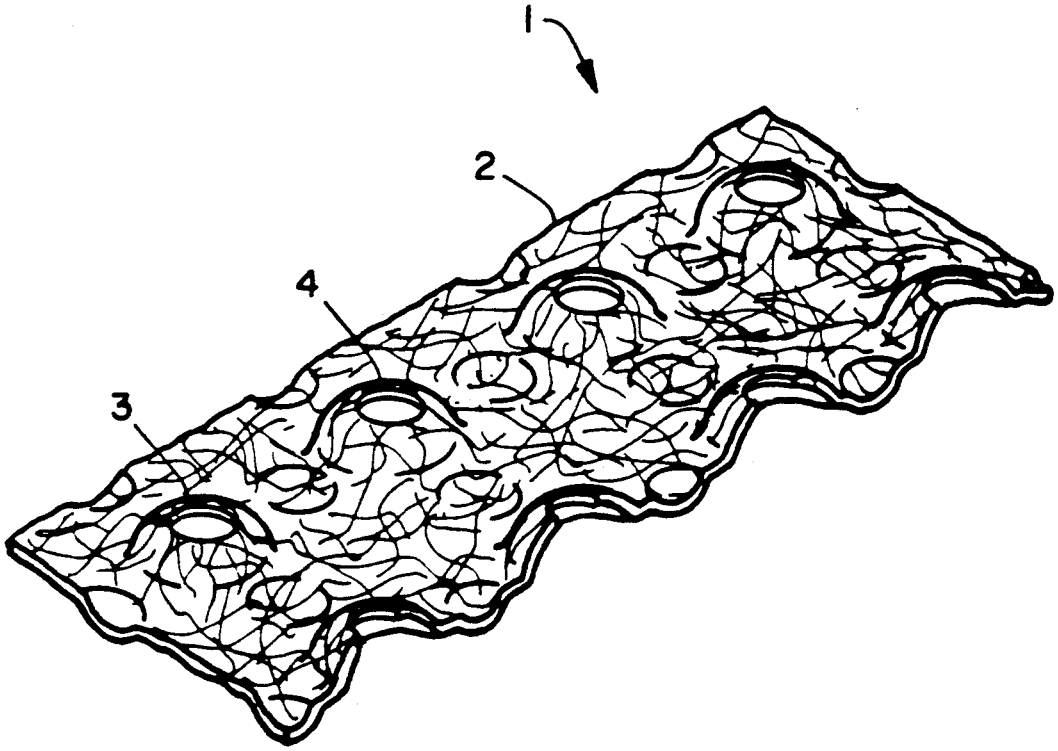
FIG. 1 is a perspective view of a sample of a nonwoven wiper of the present invention.

Referring now to the drawings, wherein like reference numerals represent the same or equivalent structure, and in particular to FIG. 1, there is shown a nonwoven wiper 1 of the present invention. The nonwoven wiper 1 includes a nonwoven web 2 of fibers having at least one raised surface area 3 defining an aperture 4 and the fibers generally adjacent the aperture 4 are substantially unconsolidated. The nonwoven wiper 1 has an oil capacity greater than about 500 percent by weight of oil to the weight of the web.

Oil capacity refers to the amount of oil that a sample of the nonwoven web will hold. A test for oil capacity is as follows: A sample 7 inches by 11 inches is cut and weighed to the nearest 0.01 g. (weight #1). After soaking for 1 minute in Blandol white mineral oil having a specific gravity in the range of 0.845 to 0.860 at 60 degrees F., the sample is removed and allowed to drip for 1 minute, then reweighed (weight #2). From these steps, the oil capacity, in percent, is calculated as follows: weight #2/Weight #1×100.

The substrate material for the nonwoven web 2 may employ various types of synthetic fibrous webs, but for cost purposes, nonwovens made by spinning or meltblowing thermoplastic polyolefin polymers, or combinations of such polymers and wood pulp, are desirable. Examples of thermoplastic polymers include polypropylene, polyethylene, polyesters and polyamides as well as copolymers and polymer blends.

A suitable material for the nonwoven web 2 is a spunbonded web of one and one-half denier or larger polypropylene fibers or filaments. Such a material is described in U.S. Pat. No. 4,340,563, to Appel, et al, issued Jul. 20, 1982, which is incorporated by reference. This material, also referred to as a linear drawn spunbonded (LDS), may be pattern bonded as described, for example, in U.S. Pat. No. 4,041,203, to Brock et al, issued Aug. 9, 1977, which is incorporated by reference.

Another suitable material for the nonwoven web 2 is a meltblown web made by a meltblowing process which is described, for example, in Wendt, Industrial and Engineering Chemistry Volume 48, No. 8 (1965) pages 1342 through 1346. Improvements in the meltblown process are described in, for example, U.S. Pat. No. 3,978,185 to Buntin et al issued Aug. 31, 1976, U.S. Pat. No. 3,795,571 to Prentice issued Mar. 5, 1974, and U.S. Pat. No. 3,811,957 to Buntin issued May 21, 1974, all of which patents are incorporated by reference.

Yet another suitable material is a bonded carded web. Such a web may be composed of 100 percent polypropylene, however, blends containing rayon, polyester and the like are equally suitable. The bonded carded web fibers range from about one and one-half to about three denier. The staple length is within the range of about one and one-half to about two inches.

When formed from synthetic thermoplastic filaments, the nonwoven web 2 may be hydrophobic and non-wettable with respect to water. For most applications, therefore, it is necessary to treat the web to make it wettable. A wide variety of anionic and nonionic wetting agents has been developed for this purpose and are in use. Examples of these are octyl phenoxy polyethoxy ethanol and dioctyl ester of sodium, sulfasuccinic acid. A particularly desirable wetting agent is dioctyl sodium sulfosuccinate. The wetting agent can be added by conventional techniques such as spraying, dipping, coating, impregnating, and printing. Generally, the wetting agent may be added in a ratio in the range of from about 0.1 percent to 1.0 percent by weight based on the weight of the nonwoven substrate. More specifically, the wetting agent may be added in a ratio of about 0.30 percent by weight based on the weight of the nonwoven substrate.

Generally, the nonwoven web 2 may have a basis weight of from about 0.5 to about 5.00 ounces per square yard. More specifically, when the web is a spunbonded web, it may have a basis weight of about 1.89 ounces per square yard.

In other embodiments the nonwoven wiper 1, may have a plurality of raised surface areas 3. In still other embodiments, both surfaces of the wiper 1 may have raised surface areas.

Referring now to FIGS. 2-6, various features of the invention will be described in greater detail.

Figure 2:
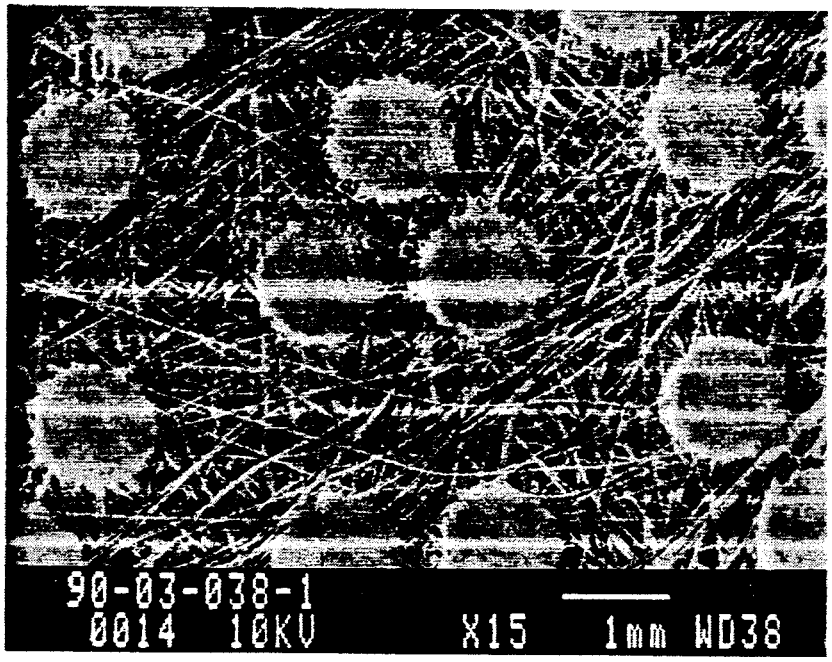
FIG. 2 is an electron microscope photograph taken on the plane of a non-apertured nonwoven web of spunbonded fabric.
Figure 3:
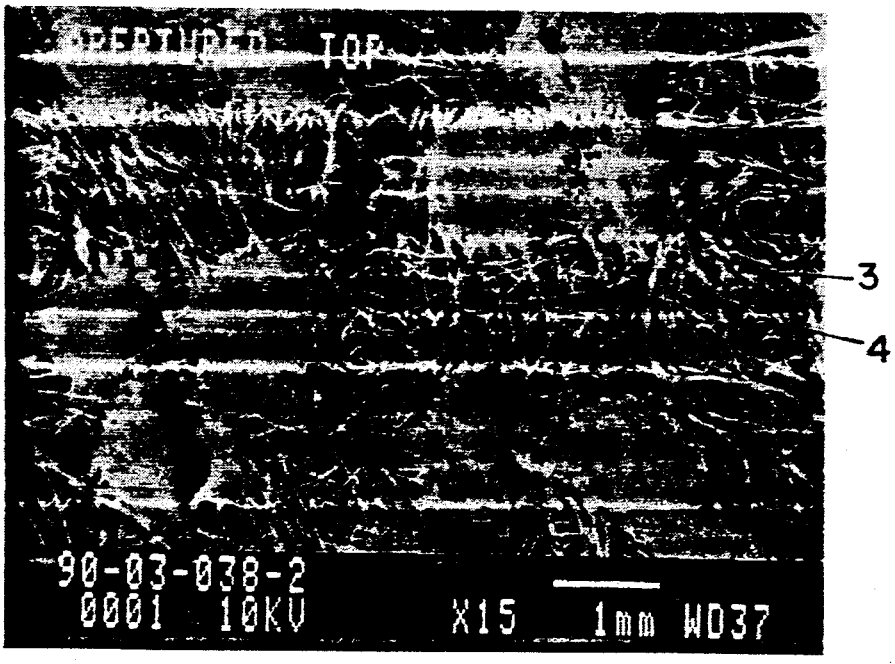
FIG. 3 is an electron microscope photograph taken on the plane of a nonwoven wiper of the present invention, showing a typical raised area with aperture.

FIG. 2, which is an electron microscope photograph taken on the plane of a non-apertured nonwoven web 2 of spunbonded fabric, provides a "before" basis against which FIG. 3 may be compared.

FIG. 3, which depicts a nonwoven wiper 1 of the present invention, shows a typical raised area 3 and an aperture 4.

Figure 4:
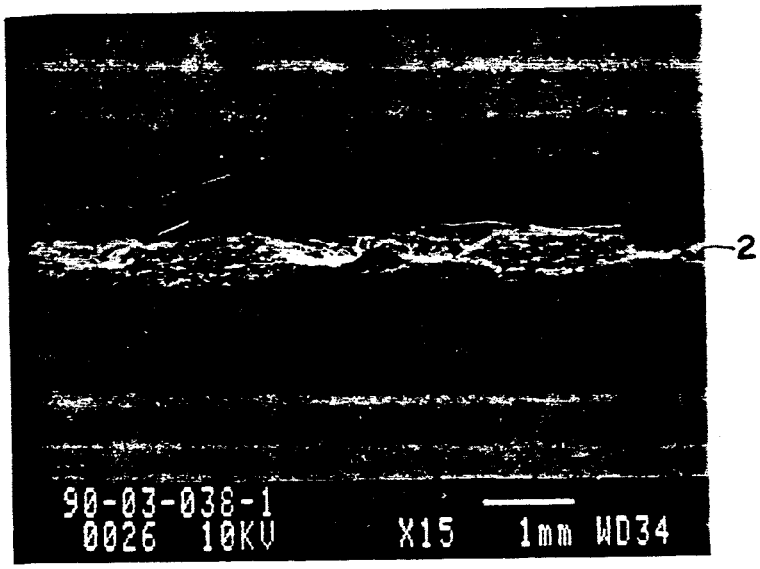
FIG. 4 is an electron microscope photograph taken on the cross-section of a non-apertured nonwoven web of spunbonded fabric.
Figure 5:
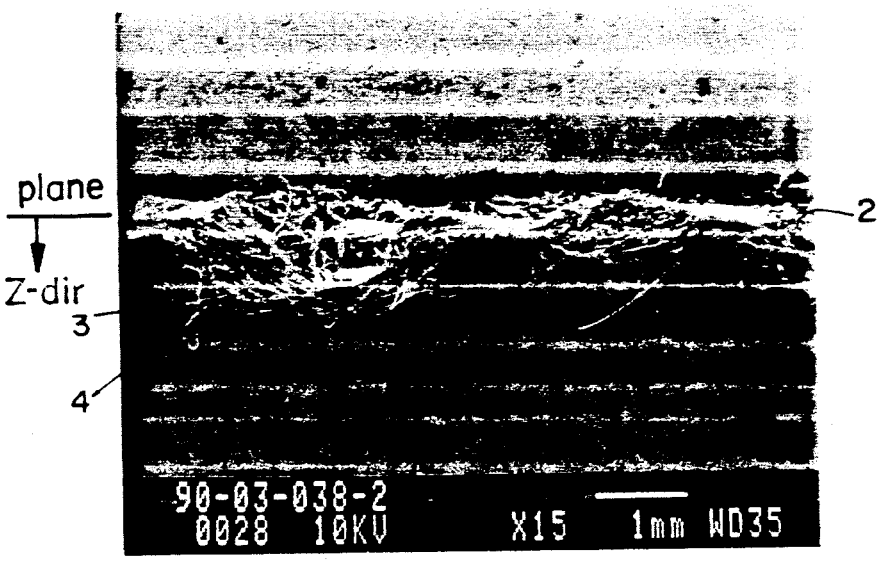
FIG. 5 is an electron microscope photograph taken on the cross-section of a nonwoven wiper of the present invention, showing a typical raised area with aperture.

FIG. 4, which is an electron microscope photograph taken on the cross-section of a non-apertured nonwoven web 2 of spunbonded fabric, provides a "before" basis against which FIG. 5 may be compared.

FIG. 5, also taken on the cross-section of a nonwoven wiper 1 of the present invention, shows a typical raised area 3 with an aperture 4.

The number of raised areas 3 averages from about 6 per square inch to about 400 per square inch of the available surface area of the web. In one embodiment, the number of raised areas averages about 100 per square inch.

Figure 6:
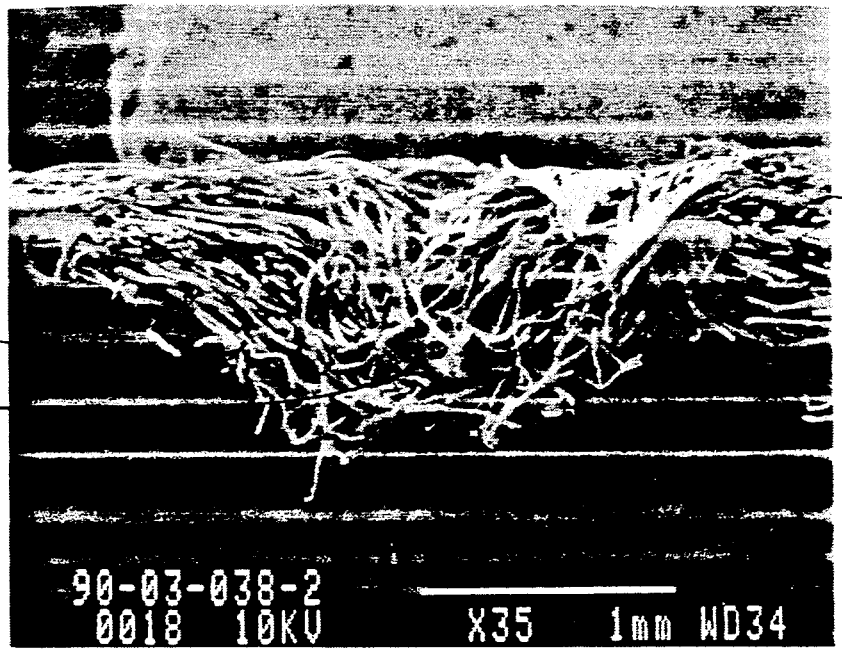
FIG. 6 is an electron microscope photograph taken on the cross-section of a nonwoven wiper of the present invention, showing a magnified view of a raised area.

FIG. 6, also an electron microscope photograph taken on the cross-section of a nonwoven wiper of the present invention, shows a magnified view of a raised area 3 and the aperture 4 defined by the raised area 3. Here, the raised area 3 appears as a dome-shaped projection extending outwardly from the web 2. In this photograph, the fibers generally adjacent the aperture 4 appear to be separated in the vertical, or z-direction. It can be seem that they are not compacted together or fused to the extent that the aperture 4 cannot close. Rather, the aperture 4 may be blocked by some fiber strands which extend across, and partially obstruct it. Finally, it appears that some of the individual fibers generally adjacent the aperture 4 may be stretched, or elongated.

Figure 7:
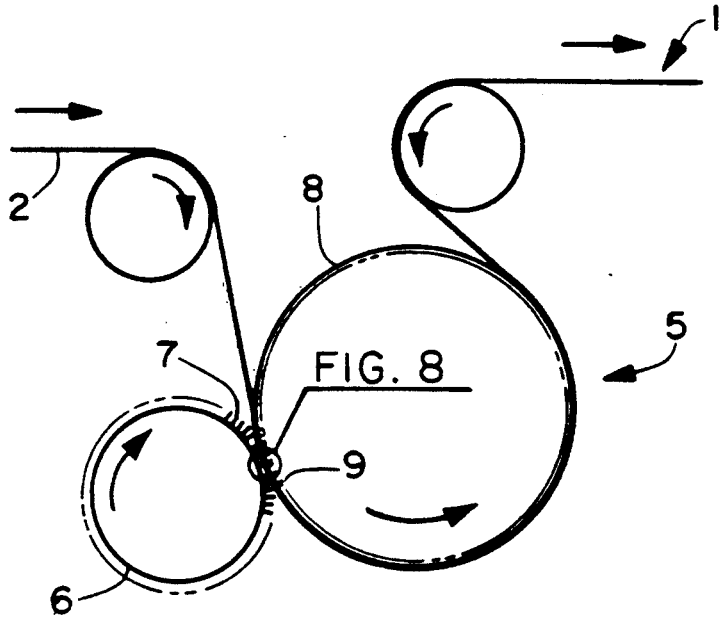
FIG. 7 is schematic diagram of the method of the present invention.
Figure 8:
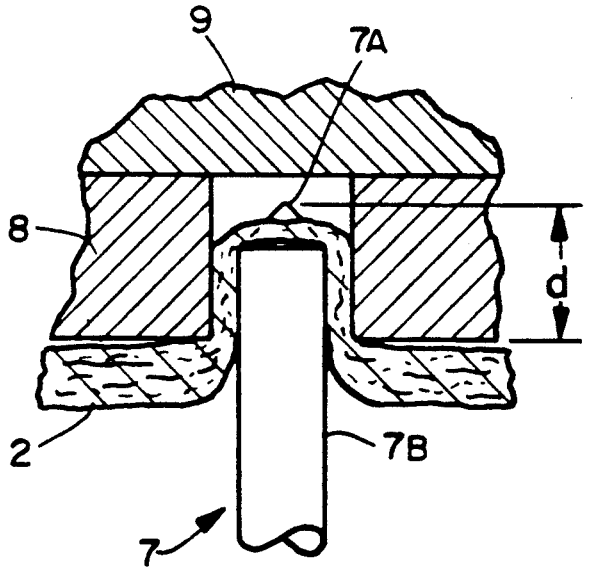
FIG. 8 is a view of a nip roller arrangement used in the method of FIG. 7, showing a pin and corresponding orifice.

Referring now to FIGS. 7 and 8, there is shown a schematic diagram of the method of the present invention. The method includes providing a nonwoven web 2 and providing a nip roller arrangement 5 including a first roller 6 having a plurality of unheated pins 7 and a second roller 8 having a plurality of corresponding unheated orifices 9. The method further includes passing the web 2 through the nip roller arrangement 5.

Generally, the nip roller arrangement 5 may be any type of perforating or aperturing apparatus having a first member or containing a series of pins and a second member containing a series of indentions or orifices for receiving entry of the pins. For example, it may be a rotary perforating system with the capability of generating a combination of holes having a variety of shapes and in a wide range of patterns with a single pass of the nonwoven web through the system. A particular apparatus which may be used for the nip roller arrangement 5 is described in U.S. Pat. No. 4,886,632, to Van Iten, et al, issued Dec. 12, 1989, which is incorporated by reference. When the Van Iten apparatus is used for the nip roller arrangement 5, it is not necessary for the rollers of the apparatus to be heated internally, instead, they may be operated at ambient temperature.

In operation, the rollers 6 and 8 are synchronously rotated while a web 2 is fed through the nip defined by the rollers. To form the raised surface areas 3, the pins 7 contact the web 2, pushing the fibers up into the corresponding orifices 9 leaving a plurality of raised surface areas 3 on the web 2. The raised surface areas 3 function to add depth to the web 2 and thereby improve the cloth-like texture and feel. To form the apertures 4, the pins 7 penetrate the web 2 at each of the raised surface areas 3, i.e., the pins 7 pass completely through the web 2. In so doing, however, the pins 7 do not thermally set any fibers with which they come into contact, so the fibers generally adjacent the aperture 4 remain substantially unconsolidated. Hence, the apertures 4 may partially close, i.e., fiber strands may remain which might extend across and partially obstruct the apertures 4.

The rollers may be operated at a speed in the range of about 25 feet per minute to about 500 feet per minute, depending on the type of substrate used for the nonwoven web 2.

Referring now to FIG. 8, to prevent interference, i.e., inadvertent contact, between the pins 7 and the interior of the corresponding orifice 9, the orifices 9 have an inside diameter at least 0.010 inch larger than the diameter of the pins 7.

The final dimensions of the raised surface areas 3 and apertures 4 are partially determined by the depth of penetration of the pin 7 through the web 2. The depth of penetration is measured by the distance from the penetrating point 7A of the pin to the surface 8A of the corresponding orifices 9. Generally, the depth of penetration may range from about 0.015 to about 0.220 of an inch.

Figure 9:
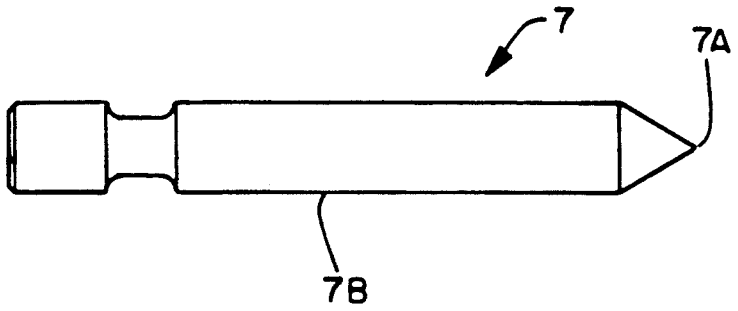
FIG. 9 is a plan view of a pin which may be used in practicing the method of the invention.

Referring now to FIG. 9, there is shown a pin 7 which may be used in practicing the method of the invention. The pin 7 has a penetrating point 7A and a shaft 7B. The diameter of the shaft 7B determines the diameter of the aperture 4 which is formed in the web 2. Generally, the pin 7 has a shaft diameter of from about 0.030 to about 0.250 of an inch. In one embodiment, the diameter of the shaft of the pin is about 0.072 of an inch.

Generally, the material used for pin 7 is a metal, such as hard or soft steel, brass, or stainless steel. A particularly desirable material is hard steel.

Alternatively, the pin 7 may have a metal core such as steel with a plastic surface. The plastic covering may be applied by coating or it may be mechanically fit by pushing the coat or layer onto the pin. The plastic coated metal pin concept is particularly advantageous since the plastic surface provides a smooth, slippery surface to the pin thus allowing it to penetrate the nonwoven fabric more readily. A suitable coating material would be a fluoropolymer coating, in particular, polytetrafluoroethylene (TEFLON by Dupont).

A metal pin may also be impregnated with plastic material. In this case, the metal surface must be porous enough to allow the actual impregnation of the plastic onto the metal. Suitable plastic materials for this impregnation include, but are not limited to, polypropylene, polyethylene and the like.

The pin 7 may have a chamfered penetrating point 7A with a chamfer angle which ranges from about 45 degrees to about 90 degrees. In one embodiment, the chamfer angle is about 60 degrees.

To demonstrate that the present invention is effective with various nonwoven webs, the following comparative examples were carried out.

EXAMPLES 1 & 2

Example 1 is a non-apertured thermally bonded carded web (TBCW) made of 100 percent polypropylene fibers.

Example 2 is an nonwoven wiper of the invention apertured according to the method of the invention, using a sample of the same basic nonwoven web as in Example 1. The apparatus used to aperture the web in Example 2 is described in U.S. Pat. No. 4,886,632, to Van Iten, et al, issued Dec. 12, 1989. The rollers of the apparatus were operated at approximately ambient room temperature degrees, and a speed of about 50 feet per minute. The orifices had an inside diameter of 0.096 of an inch, and an inside depth of 0.230 of an inch. The pins had a shaft diameter of 0.072 of an inch, a length of 0.63 inches, a penetrating point chamfer angle of degrees and a penetrating point chamfer depth of 0.062 of an inch. The pins were made of hard steel. The depth of penetration of the pins through the web was 0.104 of an inch. To make the nonwoven web wettable, it was treated with Triton GR-5M, a wetting agent, which was added by dipping in a ratio of 0.30 percent by weight based on the weight of the nonwoven web. The resulting wiper had approximately 100 raised areas per square inch. The results are shown in TABLE I.

TABLE I

| | Basis Wt. (os./sq.yd.) | Bulk (in.) | Oil Cap. (%) | Water Cap. (%) |
|---|---|---|---|---|
| Ex. 1. TBCW | 1.23 | 0.017 | 413.5 | 475.5 |
| Ex. 2. AP TBCW | 1.16 | 0.032 | 668.5 | 761.2 |

The difference in basis weight between the non-apertured web of Ex. 1 and the apertured wiper of Ex. 2 is believed to be due to normal variability of plus or minus 10% in basis weight at random points in the nonwoven web.

EXAMPLES 3 & 4

Example 3 (PPPB) is a thermally pattern bonded spunbonded polyethylene/polybutylene web available from Kimberly-Clark Corporation.

Example 4 (AP PPPB) is a nonwoven wiper of the invention made according to the method of the invention, using a sample of the same basic nonwoven web as in Example 3. The apparatus used to aperture the web in Example 4 is described in U.S. Pat. No. 4,886,632, to Van Iten, et al, issued Dec. 12, 1989. The rollers of the apparatus were operated at a temperature of approximately ambient room temperature, i.e., 70 degrees, and a speed of about 50 feet per minute. The orifices had an inside diameter of 0.096 of an inch, and an inside depth of 0.230 of an inch. The pins had a shaft diameter of 0.072 of an inch, a length of 0.63 inch, a penetrating point chamfer angle of 60 degrees and a penetrating point chamfer depth of 0.062 of an inch. The pins were made of steel. The depth of penetration of the pins through the web was 0.104 of an inch. To make the nonwoven web wettable, it was treated with triton GR-5M, a wetting agent, which was added by dipping in a ratio of 0.30 percent by weight based on the weight of the nonwoven web. The resulting wiper had approximately 100 raised areas per square inch. The results are shown in TABLE II.

TABLE II

| | Basis Wt. (os./sq.yd.) | Bulk (in.) | Oil Cap. (%) | Water Cap. (%) |
|---|---|---|---|---|
| Ex. 3. PPPB | 2.27 | 0.026 | 393.9 | 412.1 |
| Ex. 4. AP PPPB | 2.38 | 0.039 | 529.3 | 550.3 |

EXAMPLES 5,6,7 & 8

Example 5 (PESB) is a thermally pattern bonded spunbonded web made of polyethylene fibers, available from Kimberly-Clark Corporation.

Example 6 (AP PESB) is a nonwoven wiper of the invention made according to the method of the invention, using a sample of the same basic nonwoven web as in EXAMPLE 5. The apparatus used to aperture the web in Example 6 is described in U.S. Pat. No. 4,886,632, to Van Iten, et al, issued Dec. 12, 1989. The rollers of the apparatus were operated at a temperature of approximately ambient room temperature degrees, and a speed of about 50 feet per minute. The orifices had an inside diameter of 0.096 of an inch, and an inside depth of 0.230 of an inch. The pins had a shaft diameter of 0.072 of an inch, a length of 0.630 inch, a penetrating point chamfer angle of 60 degrees and a penetrating point chamfer depth of 0.062 of an inch. The pins were made of steel. The depth of penetration of the pins through the web was, 0.104 of an inch. To make the nonwoven web wettable, it was treated with Triton GR-5M, a wetting agent, which was added by dipping in a ratio of 0.30 percent by weight based on the weight of the nonwoven web. The resulting wiper had approximately 100 raised areas per square inch. The results are shown in TABLE III.

Example 7 (SB) is a thermally pattern bonded spunbonded web made of polypropylene fibers, available under the tradename ACCORD from Kimberly-Clark Corporation.

Example 8 (AP SB) is a nonwoven wiper of the invention made according to the method of the invention, using a sample of the same basic nonwoven web as in Example 7. The apparatus used to aperture the web in Example 8 is described in U.S. Pat. No. 4,886,632, to Van Iten, et al, issued Dec. 12, 1989. The rollers of the apparatus were operated at a temperature of approximately ambient room temperature degrees, and a speed of about 50 feet per minute. The orifices had an inside diameter of 0.096 of an inch, and an inside depth of 0.230 of an inch. The pins had a shaft diameter of 0.072 of an inch, a length of 0.63 inch, a penetrating point chamfer angle of 60 degrees and a penetrating point chamfer depth of 0.062 of an inch. The pins were made of steel. The depth of penetration of the pins through the web was 0.104 of an inch. To make the nonwoven web wettable, it was treated with Triton GR-5M, a wetting agent, which was added by dipping in a ratio of 0.30 percent by weight based on the weight of the nonwoven web. The resulting wiper had approximately 100 raised areas per square inch. The results are shown in TABLE III.

TABLE III

| | Basis Wt. (os./sq.yd.) | Bulk (in.) | Oil Cap. (%) | Water Cap. (%) |
|---|---|---|---|---|
| Ex. 5. PESB | 2.02 | 0.028 | 458.3 | 200.7 |
| Ex. 6. AP PESB | 1.94 | 0.032 | 588.7 | 242.3 |
| Ex. 7. SB | 1.76 | 0.025 | 374.5 | 426.7 |
| Ex. 8. AP SB | 1.89 | 0.045 | 496.0 | 552.0 |

The present invention has been described in connection with certain preferred embodiments. It is intended not to be limited to those embodiments, but to include all alternatives, modifications and equivalents as can be included within the spirit and scope of the following claims.

What is claimed is:

1. A nonwoven wiper having an oil capacity greater than about 500 percent by weight of oil to the weight of the web consisting essentially of:

a nonwoven web of fibers having at least one raised surface area defining an aperture where the fibers generally adjacent the aperture are substantially unconsolidated.

2. A wiper as recited in claim 1, wherein the nonwoven web is a spunbonded web.

3. A wiper as recited in claim 2, wherein the nonwoven web has a basis weight of from about 0.5 to about 5.0 ounces per square yard.

4. A wiper as recited in claim 3, wherein the nonwoven web has a basis weight of about 1.89 ounces per square yard.

5. A wiper of claim 1, having a plurality of raised surface areas with both surfaces of the wiper having raised areas.

6. A wiper as recited in claim 1, wherein the raised area has an average height, measured from the base plane of the web in the z-direction of the web to the most extended fibers of the raised area from about 0.0075 to about 0.125 inches.

7. A wiper as recited in claim 1, wherein the number of raised areas averages from about 6 per square inch to about 400 per square inch.

8. A wiper as recited in claim 1, wherein the number of raised areas averages about 100 per square inch.

9. A high capacity nonwoven comprising thermoplastic fibers and having a basis weight generally in the range of from about 0.5 ounces per square yard to about 5.0 ounces per square yard and comprised of an average of about 6 to about 100 raised surface areas per square inch, said raised surface areas having an average height in the range of from about 0.0075 inch to about 0.125 inch and being defined by an aperture which may be partially closed by fibers extending across the aperture and which has adjacent fibers that are substantially unconsolidated and not fixed in position with respect to the other fibers in the web.

10. A method of forming a nonwoven wiper having an oil capacity of greater than about 500 percent by weight of the wiper, comprising the steps of:

providing a nonwoven web;

providing a nip roller arrangement including a first roller having a plurality of unheated pins and a second roller having a plurality of corresponding orifices;

passing the web through the nip roller arrangement to form a plurality of raised surface areas on the web with each of the surface areas defining an aperture where the fibers generally adjacent the aperture are substantially unconsolidated.

11. A method as recited in claim 10, wherein each of the pins has a shaft diameter of from about 0.030 to about 0.250 of an inch.

12. A method as recited in claim 10, wherein the diameter of the shaft of the pins is about 0.072 of an inch.

13. A method as recited in claim 10, wherein each of the pins has a chamfered end with a chamfer angle which ranges from about 45 degrees to about 90 degrees.

14. A method as recited in claim 10, wherein the depth of penetration of the pins through the web ranges from about 0.015 to about 0.220 of an inch.

15. A method as recited in claim 10, wherein the pins are comprised of a metal.

16. A method as recited in claim 10, wherein the pins are stainless steel.

17. A method as recited in claim 10, wherein the orifice diameter is at least 0.010 inch greater than the diameter of the corresponding pin shaft.

18. A method as recited in claim 10, wherein the raised areas extend outwardly from both surfaces of the web.

19. A nonwoven wiper having an oil capacity greater than about 500 percent by weight of oil to the weight of the web, formed by the method of claim 10.

* * * * *

UNITED STATES PATENT AND TRADEMARK OFFICE

CERTIFICATE OF CORRECTION

PATENT NO. : 5,223,319

DATED : June 29, 1993

INVENTOR(S) : James D. Cotton and Paul J. King

It is certified that error appears in the above-identified patent and that said Letters Patent is hereby corrected as shown below:

Column 4, line 66, "can be seem that they" should read --can be seen that they--.

Column 3, line 43, "weight #2/Weight #1 x 100" should read $$--\frac{(\text{weight \#2 - weight \#1})}{\text{weight \#1}} \times 100--$$

Column 4, line 17, "sodium sulfsuccinac acid" should read --sodium sulfosuccinic acid--.

Column 7, line 54, "the web was, 0.104.." should read --the web was 0.104..--.

Signed and Sealed this

Nineteenth Day of July, 1994

Bruce Lehman

*Attest:*

BRUCE LEHMAN

*Attesting Officer*

*Commissioner of Patents and Trademarks*